United States Patent [19]

Berberich

[11] Patent Number: 4,683,821

[45] Date of Patent: Aug. 4, 1987

[54] PROCESS FOR MULTI-COLOR INK TAMPON PRINTING

[75] Inventor: Bernd Berberich, Schwieberdingen, Fed. Rep. of Germany

[73] Assignee: TAMPOflex GmbH, Fed. Rep. of Germany

[21] Appl. No.: 808,488

[22] Filed: Dec. 13, 1985

[30] Foreign Application Priority Data

Oct. 5, 1984 [DE] Fed. Rep. of Germany ..... 3436688

[51] Int. Cl.[4] ..... B41F 1/10; B41F 1/16

[52] U.S. Cl. ..... 101/170; 101/211; 101/193

[58] Field of Search ..... 101/41, 42, 43, 44, 101/193, 195, 200, 426, 170, 211, 163, 164, 169

[56] References Cited

U.S. PATENT DOCUMENTS 4,240,344 12/1980 Smith ..... 101/44

FOREIGN PATENT DOCUMENTS 1135115 11/1982 Canada ..... 101/44
12690 1/1982 Japan ..... 101/44
110253 6/1983 Japan ..... 101/41

*Primary Examiner*—J. Reed Fisher
*Attorney, Agent, or Firm*—Thomas W. Speckman; Ann W. Speckman

[57] ABSTRACT

The invention provides a process for ink tampon printing, wherein printing forms are taken from inked printing blocks by ink tampons and transferred to work pieces mounted in work piece holders. To achieve multicolor printing of a work piece with a single work piece holder, the process of the present invention provides that a plurality of printing forms are taken from a printing block or printing blocks by a plurality of ink tampons aligned next to one another, that the ink tampons are then located in printing positions and the work piece is sequentially located in the printing positions by means of adjustment of the single work piece holder on a sliding track, and through sequential printing and reset strokes of the ink tampons, along with the corresponding adjustment of the work piece holder to the printing positions of the ink tampons, the printing forms are successively transferred to the single work piece mounted in a single work piece holder.

20 Claims, 1 Drawing Figure

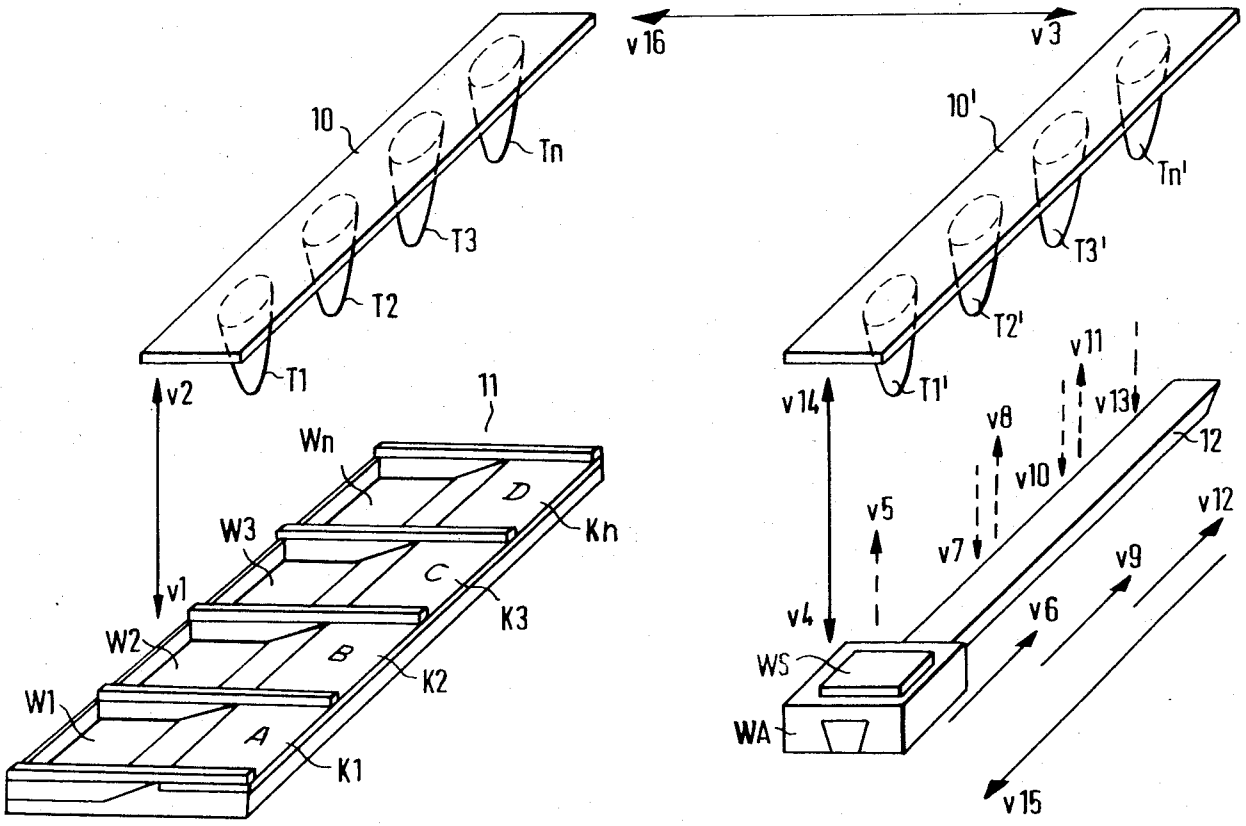
Tn'
T3'
T2'
T1'
10'
v3
v16
v14
v5
v7
v8
v10
v11
v13
12
v12
v9
v6
v15
v4
WS
WA
Tn
T3
T2
T1
10
v2
v1
11
Kn
K3
K2
K1
D
C
B
A
Wn
W3
W2
W1

PROCESS FOR MULTI-COLOR INK TAMPON PRINTING

BACKGROUND OF THE INVENTION

1. Field of the Invention

The present invention relates to a process for multi-color ink tampon printing, wherein a plurality of ink tampons are positioned next to one another, printing forms are taken from inked printing blocks, and are successively transferred to a work piece mounted on a work piece holder which, during the course of a printing cycle, is sequentially brought forward in a rhythmic movement into the printing position of each ink tampon.

2. Description of the Prior Art

A process of this general type is known from the periodical "druckprint", 3/1980, page 148. In this known multi-color ink tampon printing process, work pieces in work piece holders are positioned under each ink tampon in the printing position, so that with each pressure stroke all the printing forms taken from the differently inked printing blocks are transferred to work pieces, and specifically to different work pieces. This process requires a large number of work piece holders, which are positioned on an endless conveyor track or a rotary indexing table or the like. After each printing stroke, all the ink tampons are inked again, and each work piece holder is advanced by one printing position.

This known process is suited for the printing of mass articles, since only if a large number of work pieces are to be printed is the expense of numerous work piece holders justified.

SUMMARY OF THE INVENTION

It is an objective of the present invention to provide a process for multi-color ink tampon printing of the type described above, which is economically feasible even for small numbers of work pieces to be printed due to lower expense for work piece holders.

In accordance with the process of the present invention, a single work piece holder accommodating a work piece is used throughout a printing cycle. After the printing forms have been transferred to ink tampons from the differently inked printing block or printing blocks in a given printing cycle, the work piece is located in a printing position at an ink tampon by shifting the work piece holder on a sliding rail. Subsequently, by sequentially adjusting the work piece holder in the printing positions of successive ink tampons, the printing forms are applied successively in each printing cycle by repeated pressure strokes and reset strokes of individual tampons, onto a single work piece fixed in a single work piece holder.

The expense associated with a plurality of work piece holders is limited because a single work piece holder is required. By variable adjustment of the ink tampons, the reception of all printing forms from the differently inked printing blocks takes place simultaneously in each cycle, and due to the aligned printing positions of the ink tampons, the different printing forms are transferred onto the work piece with a corresponding number of printing strokes and reset strokes of the ink tampons, as the work piece is moved sequentially from printing position to printing position. After all printing forms have been transferred from the ink tampons to the work piece, the transfer of new printing forms to the ink tampons takes place simultaneously.

In accordance with one embodiment, the printing process is accelerated when the printing block or printing blocks are inked using a multiple inking device and a multiple wiping device in a multiple color ink pan comprising several individual ink pans, and the inking and wiping process is incorporated in a continuous printing cycle.

Application or removal of a work piece into or out of the work piece holder is facilitated by the fact that the work piece holder is moved into an operating position through the first and/or last printing position. The work piece may, in these positions, be subjected to a prior or subsequent treatment.

Continuous printing cycles are achieved in a further embodiment wherein the work piece holder is gradually advanced in one adjustment direction, while it is returned in the opposite direction to the starting position by a single reset movement traversing all the printing positions. This is particularly important if a specific sequence of colors must be utilized in a multi-color printing job. In this embodiment, the first printing position or an operating position located before it may be selected as the starting position. The printed work piece is removed from the work piece holder after every printing cycle, and a unprinted work piece is applied.

To shorten printing cycles, an embodiment is preferred wherein the work piece holder is step-wise displaced and separate printing cycles occur in both directions; that in each final position of the work piece holder, the printed work piece is removed and replaced with an unprinted work piece; and that, with each directional change of the adjustable work piece holder, the ink tampons take new printing forms from the printing block or printing blocks. The embodiment utilizing separate printing cycles taking place in both adjustment directions of the work piece holder may be used in multi-color printing processes in which the color sequence is not critical, as well in collecting an imprint from several printing forms of the same color.

The first and last printing position or the operating positions lying beyond these positions are designated the starting positions.

A further shortening of the printing cycles is provided when, after the first pressure stroke and before the last reset stroke of a printing cycle, the pressure strokes and the reset strokes of the tampons are shortened to provide a reduced travel distance.

If, in accordance with another embodiment, the number of strokes in a printing cycle is preset, or preprogrammed, the process may easily be adapted to accommodate a different number of printing forms. Suitable freely-programmable controls and specially formed positioner drives are known, and are used, for example, for control of machine tools.

To properly align the tampons with the printing block or printing blocks, a further embodiment provides that the ink tampons are adjustably positioned on a carrier and manually adjusted to the distances between the printing forms corresponding to the printing block or printing blocks. To eliminate manual adjustment of the ink tampons, the positions of the ink tampons on the carrier and also the printing positions of the work piece holder on its sliding rail are coordinated with one another and may be preset by a program.

A further shortening of the printing cycle may be provided in accordance with another embodiment wherein the reset strokes of the ink tampons to the printing positions and the return of the work piece holder to the starting position are carried out at a greater speed than the pressure strokes of the ink tampons and the adjusting movement of the work piece holder.

In accordance with another embodiment, after each printing cycle including positioning the ink tampons in their printing positions and returning the work piece holder to the starting position, the ink tampons remain in the printing positions. Inking and wiping of the printing block or the printing blocks then occurs when a new printing cycle is initiated.

BRIEF DESCRIPTION OF THE DRAWING

The present invention is shown in greater detail in the FIGURE showing a highly schematic representation of the process.

DESCRIPTION OF PREFERRED EMBODIMENTS

Ink tampons T1–Tn are aligned in a row on support (10), their distances from one another corresponding to the arrangement of printing forms A–D on printing block or printing blocks K1–Kn. Printing forms A–D may be positioned on a single printing block or individual printing blocks K1–Kn. Multiple color pan (11) connects with the printing block or printing blocks K1–Kn and the color pans may be subdivided into individual color pans W1–Wn by partitions. Inking and wiping of the printing block or printing blocks K1–Kn takes place in the known manner by means of a multiple inking device and a multiple wiper device.

Work piece WS to be printed is mounted on work piece holder WA which is adapted for holding it. Work piece holder WA may be adjustable on sliding rail (12).

In the position shown in the drawing, ink tampons T1–Tn are in an ink receiving position. As the arrow v1 indicates, support (10), at the beginning of a printing cycle, lowers ink tampons T1–Tn so that ink tampons T1–Tn receive printing forms A–D from the inked and wiped printing block or printing blocks K1–Kn. After ink tampons T1–Tn have been raised from the printing block or printing blocks K1–Kn in the direction v2, support (10) with the ink tampons, as shown by arrow v3, is positioned at printing positions T1′–Tn′ above the sliding rail of work piece holder WA. With pressure stroke v4, the printing process begins. Work piece holder WA initially rests beneath ink tampon T1 in printing position T1′. Printing form A from ink tampon T1 is transferred to work piece WS which is retained on work piece holder WA. Reset stroke v5 raises support (10) only far enough so that ink tampon T1 is released from work piece WS. Reset stroke v5 may thus be shorter than reset stroke v14 required at the end of the printing cycle, to shorten the printing cycle. Work piece holder WA is adjusted by displacement v6 on sliding rail (12), which locates it at printing position T2′ under ink tampon T2. Then pressure stroke v7 and reset stroke v8 take place. Printing form B from ink tampon T2 is transferred to work piece WS. Work piece holder WA undergoes a further displacement v9, which locates it at printing position T3′ under ink tampon T3. During pressure stroke v10, printing form 1C is transferred to work piece WS. Reset stroke v11 releases work piece WS, so that, with displacement v12 of work piece holder WA, the last printing position Tn′ is attained. Pressure stroke v13 transfers printing form D onto work piece WS. Support (10) with ink tampons T1–Tn is, as arrow v14 shows, fully raised, so that it may be returned to the ink receiving position at printing block or printing blocks K1–Kn, as indicated by arrow v16. This may already be the beginning of a new printing cycle. At the end of the printing cycle, the ink tampons remain in their printing positions. Parallel to the printing positions, work piece holder WA can be relocated in a starting position, such as printing position T1′, as arrow v15 shows. This resetting may occur at greater velocities than adjustment displacements v6, v9 and v12 of work piece holder WA. Reset strokes v5, v8, v11 and v14 of support (10) with ink tampons T1–Tn may also occur faster than printing strokes v4, v7, v10 and v13.

Work piece holder WA may, in addition to printing positions T1′–Tn′, have other operating positions, which are used for prior and/or subsequent treatments of work piece WS. These additional operating positions may also facilitate the placement of work piece WS in work piece holder WA and removal of the work piece from work piece holder WA. A corresponding adjustment displacement of work piece holder WA may precede printing stroke v4, to displace work piece holder WA from its operating position designated the starting position into printing position T1′. Between reset stroke v14 and return displacement v16 of support (10) with ink tampons T1–Tn to the printing form receiving position, work piece holder WA may be located in another operating position after printing position Tn′. This is particularly advantageous if, in a subsequent printing cycle, reset adjustment v15 proceeds step-wise as its own printing cycle traversing printing positions Tn′–T1′ sequentially, whereby the pressure strokes and reset strokes proceed in the following sequence: v13-v11-v10-v8-v7-v5-v4-v14, and the adjustment displacements proceed in the sequence v12-v9-v6, but in opposite directions.

So that ink tampons T1–Tn correctly receive printing forms A–D, it is suitable to install the ink tampons adjustably on support (10), so that they may be aligned with printing forms A–D of the printing block or printing blocks K1–Kn. This alignment may also be automatically preselected and accomplished with a programmable control and a known type of positioning drive. Alignment of ink tampons T1–Tn is coupled with the corresponding printing positions T1′–Tn′ of work piece holder WA. The number of pressure strokes and reset strokes may be preset by a program, so that the printing cycle may be shortened or lengthened correspondingly. Support (10) is provided with the number n of ink tampons which corresponds to the maximum number of colors in multicolor printing process or the maximum number of printing forms for an imprint being assembled.

I claim:

1. A process for multicolor ink tampon printing of the type wherein a plurality of ink tampons are aligned next to one another on a support means, a plurality of printing forms are aligned on a plurality of printing blocks, a work piece to be printed is mounted on a work piece holder, and said support means with said aligned ink tampons is movable with respect to said printing blocks and said work piece holder, said process comprising: simultaneously transferring each said printing form (A–D) from each said printing block (K1–Kn) to one said ink tampon (T1–Tn) by moving said support means with respect to said printing blocks to contact each said ink tampon to one said printing block and release said ink tampons; simultaneously locating said support means with said aligned ink tampons and said work piece holder (T1–Tn) in a first printing position (T1') wherein a first ink tampon is positioned above said work piece and transferring said printing form from said first ink tampon to said work piece by moving said support means with respect to said work piece holder in a first printing stroke to contact said first ink tampon to said work piece and a first reset stroke to release said first ink tampon from said work piece; and sequentially moving said work piece holder with respect to said support means to locate said aligned ink tampons in successive printing positions with respect to said work piece and successive printing strokes transferring each said printing form from each said ink tampon to said work piece by successive printing strokes contacting each said ink tampon to said work piece and reset strokes releasing each said ink tampon, said trnsferring said printing forms from said printing blocks to said work piece comprising a printing cycle.

2. A process in accordance with claim 1, additionally comprising simultaneously inking and wiping each said printing block (K1–Kn) with a multiple inking and wiping device utilizing a multiple color ink pan comprising separated ink pans (W1–Wn), and wherein said printing cycle additionally comprises inking and wiping said printing blocks.

3. A process in accordance with claim 2, additionally comprising adjusting said work piece holder (WA) to an operating position aligned with and displaced from said printing positions from a last said printing position (Tn').

4. A process in accordance with claim 3, wherein said work piece holder (WA) is sequentially moved in a first direction during successive transfer of each said printing form from each said ink tampon to said work piece, and said work piece holder is moved from the last said printing position to a starting position by a single reset step in a second direction opposite said first direction, said work piece holder traversing all said printing positions (Tn'–T1') during said reset step.

5. A process in accordance with claim 4, wherein said starting position is one of said first printing position and said operating position.

6. A process in accordance with claim 5, additionally comprising removing said printed work piece (WS) from said work piece holder (WA) after each said printing cycle, and then mounting an unprinted work piece (WS) in said work piece holder.

7. A process in accordance with claim 3, wherein said work piece holder (WA) is sequentially moved in a first direction to a first terminal position during successive transfer of each said printing form form each said ink tampon to said work piece, and said work piece holder is additionally moved sequentially through all said printing positions in a second direction opposite said first direction to a second terminal position; said printing forms (A–D) are transferred from said printing blocks (K1–Kn) to said ink tampons prior to movement of said work piece holder in said first and said second directions, said printing forms are transferred from said ink tampons to said work piece during movement of said work piece holder in both said first and second directions, and a printed work piece is removed and replaced by an unprinted work piece at each said terminal position.

8. A process in accordance with claim 7, wherein said work piece holder is adjusted to a starting position after said printing cycle, and said starting position is one of: said first printing position, the last said printing position, and an operating position aligned with and displaced-from said first and last printing positions.

9. A process in accordance with claim 8, wherein a first said printing stroke and a last siad reset stroke take place over a full stroke distance, and after said first printing stroke and before said last reset stroke of said support means with said ink tampons during said printing cycle, said printing strokes and said reset strokes of said ink tampons (T1'–Tn'), respectively, take place over a reduced said stroke distance.

10. A process in accordance with claim 9, wherein the number of said printing and reset strokes during said printing cycle is preset.

11. A process in accordance with claim 10, wherein said ink tampons (T1–Tn) are adjustably positioned on said support means (10), and are manually adjusted prior to said printing cycle to correspond to distances between said printing forms (A–D) on said printing blocks (K1–Kn).

12. A process in accordance with claim 11, wherein said work piece holder is slidable on a rail (12), alignment of said ink tampons (T1–Tn) on said support means (10) and movement of said work piece holder (WA) on said rail (12) correspond to one another and to said printing positions (T1'–Tn'), and said movement of said work piece holder is preset by a program.

13. A process in accordance with claim 12, wherein said reset strokes of said ink tampons in said printing positions (T1'–Tn') and said single reset step of said work piece holder (WA) to said starting position take place with greater velocity than said printing strokes of said ink tampons and said movement of said work piece holder (WA).

14. A process in accordance with claim 13, wherein after each said printing cycle, said ink tampons (T1–Tn) remain in said printing positions (T1'–Tn') and said work piece holder (WA) moved to said starting position.

15. A process in accordance with claim 1, additionally comprising adjusting said work piece holder (WA) to an operating position aligned with and displaced from said printing positions from last said printing position (Tn').

16. A process in accordance with claim 1, wherein said work piece holder (WA) is sequentially moved in a first direction during successive transfer of each said printing form from each said ink tampon to said work piece, and said work piece holder is moved from the last said printing position to a starting position by a single reset step in a second direction opposite said first direction, said work piece holder traversing all said printing positions (Tn'–T1') during said reset step.

17. A process in accordance with claim 1, additionally comprising removing said printed work piece (WS) from said work piece holder (WA) after each said printing cycle, and then mounting an unprinted work piece (WS) in said work piece holder.

18. A process in accordance with claim 1, wherein said work piece holder (WA) is sequentially moved in a first direction to a first terminal position during successive transfer of each said printing form from each said ink tampon to said work piece, and said work piece holder is additionally moved sequentially through all said printing positions in a second directon opposite said first direction to a second terminal position; said printing forms (A–D) are transferred from said printing blocks (K1–Kn) to said ink tampons prior to movement of said work piece holder in said first and second directions, and printing forms are transferred from said ink tampons to said workpiece during movement of said work piece holder in both said first and second direction, and a printed work piece is removed and replaced by an unprinted work piece at each said terminal position.

19. A process in accordance with claim 1, wherein a first said printing stroke and a last said reset stroke take place over a full stroke distance, and after said first printing stroke and before a last said reset stroke of said support means with said ink tampons during said printing cycle, said printing strokes and said reset strokes of said ink tampons (T1′–Tn′), respectively, take place over a reduced said stroke distance.

20. A process in accordance with claim 1 wherein said work piece holder is slidable on a rail (12), alignment of said ink tampons (T1–Tn) on said support means (10) and movement of said work piece holder (WA) on said rail (12) correspond to one another and to said printing positions (T1′–Tn′), and said movement of said work piece holder is preset by a program.

* * * * *